US008926368B2

(12) United States Patent
Il

(10) Patent No.: US 8,926,368 B2
(45) Date of Patent: Jan. 6, 2015

(54) SHIELDED CONNECTOR

(71) Applicant: Yazaki Corporation, Tokyo (JP)

(72) Inventor: Ryosuke Il, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 98 days.

(21) Appl. No.: 13/870,527

(22) Filed: Apr. 25, 2013

(65) Prior Publication Data

US 2013/0288523 A1 Oct. 31, 2013

(30) Foreign Application Priority Data

Apr. 26, 2012 (JP) ..... 2012-101732

(51) Int. Cl.

| | |
|---|---|
| ***H01R 13/648*** | (2006.01) |
| ***H01R 13/658*** | (2011.01) |
| ***H01R 13/6581*** | (2011.01) |
| *H01R 13/422* | (2006.01) |
| *H01R 9/03* | (2006.01) |

(52) U.S. Cl.

CPC ..... *H01R 13/658* (2013.01); *H01R 13/4223* (2013.01); *H01R 13/6581* (2013.01); *H01R 9/038* (2013.01)

USPC ..... 439/607.5

(58) Field of Classification Search

USPC ..... 439/607.5, 607.41, 607.47, 607.48

See application file for complete search history.

(56) References Cited

U.S. PATENT DOCUMENTS

| | | | | |
|---|---|---|---|---|
| 5,421,744 | A | 6/1995 | Hio | |
| 5,683,269 | A * | 11/1997 | Davis et al. | 439/607.5 |
| 6,887,106 | B2 * | 5/2005 | Noguchi et al. | 439/607.56 |
| 2013/0052866 | A1 * | 2/2013 | Il | 439/607.41 |
| 2013/0171872 | A1 * | 7/2013 | Kanda et al. | 439/607.41 |

FOREIGN PATENT DOCUMENTS

JP 6-223909 A 8/1994

* cited by examiner

*Primary Examiner* — Gary Paumen

(74) *Attorney, Agent, or Firm* — Kenealy Vaidya LLP

(57) ABSTRACT

A shielded connector includes: an inner housing including a plurality of terminal accommodation chambers into which male terminals crimped to a plurality of shielded-wire ends of a shielded electric wire are inserted; and a shield shell including a cylindrical shield part which covers the inner housing and a barrel part which crimps and fixes a sheath part of the shielded electric wire. A bottom part of the shield shell is formed with an opening that prevents leading end portions of the male terminals from interfering with the bottom part when the inner housing is inserted into the shield part.

2 Claims, 14 Drawing Sheets

SHIELDED CONNECTOR

CROSS-REFERENCE TO RELATED APPLICATION(S)

This application is based upon and claims the benefit of priority from prior Japanese patent application No. 2012-101732, filed on Apr. 26, 2013, the entire contents of which are incorporated herein by reference.

BACKGROUND

The presently disclosed subject matter relates to a shielded connector.

There is a shielded connector which includes: an insulated connector housing that includes a terminal accommodation hole in which a terminal fitting connected to a core wire of a shielded wire is inserted and accommodated from a rear side part; and a conductive shield cover that is fitted onto the connector housing and is electrically connected to a shielded conductor of the shielded wire at the state where it is fitted onto the connector housing (for example, refer to JP-A-6-223909).

As shown in FIG. 14, a shielded connector 501 disclosed in JP-A-6-223909 is configured by a cylindrical insulated sheath 503, a shielded wire 505, an insulated connector housing 507, and a conductive shield cover 509. After mounting the connector housing 507 to a leading end of the shielded wire 505 which passes through the insulated sheath 503 in advance, the shield cover 509 is fitted onto the connector housing 507, and then the insulated sheath 503 is mounted to the shield cover 509.

The shielded wire 505 has a general structure where core wires 511 are bound together, outer peripheries thereof are covered with a mesh-type shielded conductor 513 through an insulated sheath and the shielded conductor 503 is further covered by a sheath 515. Terminal fittings 517 are fastened to leading ends of the core wires 511.

The shield cover 509 is a cylindrical member that is formed by bending a conductive metal plate. A front end portion of the shield cover 509 is an outer fitting part 519 that is closely attached on an outer surface of the connector housing 507, and a central portion of the shield cover 509 is an insertion part 523 including a cover part 521 that is opened upwards. Also, a rear end portion of the shield cover 509 is a connection part 525 that bites the shielded conductor 513 of the shielded wire 505 and is thus electrically connected thereto. The shield cover 509 is attached to the shielded wire 505 and the connector housing 507 by opening the cover part 521, inserting the connector housing 507 into the insertion part 523, relatively moving forward the connector housing 507 to push the connector housing 507 into the outer fitting part 519, and deforming the connection part 525 to thus crimp the shielded conductor 513.

As an electric wire of a USB 2.0 (differential connector for high-speed transmission) relay connector, a special shielded wire is used so as to satisfy transmission performance and noise-resistance performance. The special shielded wire has a stand-alone structure satisfying the performance. Thus, when an electric wire sheath (sheath 515 or shielded conductor 513) is stripped at a connection part to be connected to a connector terminal, the part whose sheath is stripped causes an impedance mismatch to thus deteriorate the transmission performance. Hence, a length of the sheath that is stripped is preferable as short as possible.

Due to the above reason, the special shielded wire has a short length within which the electric wire sheath for crimping the male terminals (terminal fittings 517) to the shielded-wire ends is stripped. Hence, an interval between the cylindrical shield part (outer fitting part 519) of the shield shell (shield cover 509) and the barrel part (connection part 525) is narrowed. That is, an axial length of the insertion part 523 is shortened. Therefore, in the shield shell having a structure where the insertion part 523 is narrow, the inner housing (connector housing 507) having the male terminals inserted therein is obliquely inserted into the insertion part 523, slid, and then mounted to the cylindrical shield part.

However, if the insertion part 523 is narrow, when inserting the inner housing, in which the male terminals crimped to the shielded wire 505 are inserted, into the shield shell, leading ends of the male terminals protruding from the inner housing are contacted to a bottom surface of the shield shell, so that the smooth insertion may not be made.

SUMMARY

The presently disclosed subject matter may provide a shielded connector capable of preventing a leading end portion of a male terminal from interfering with a shield shell upon insertion of an inner housing.

The shielded connector may comprise: an inner housing including a plurality of terminal accommodation chambers into which male terminals crimped to a plurality of shielded-wire ends of a shielded electric wire are inserted; and a shield shell including a cylindrical shield part which covers the inner housing and a barrel part which crimps and fixes a sheath part of the shielded electric wire, wherein a bottom part of the shield shell is formed with an opening that prevents leading end portions of the male terminals from interfering with the bottom part when the inner housing is inserted into the shield part.

The opening may be configured by a slit that extends along a terminal insertion direction of the shield shell and that has a width enabling the male terminals to pass therethrough.

The presently disclosed subject matter has been briefly described. The detailed configurations of the presently disclosed subject matter will be more clearly understood by reading through an illustrative embodiment for implementing the presently disclosed subject matter with reference to the accompanying drawings.

DETAILED DESCRIPTION OF EXEMPLARY EMBODIMENTS

Hereinafter, an illustrative embodiment of the presently disclosed subject matter will be described with reference to the drawings.

A shielded connector 11 of the illustrative embodiment can be appropriately used as a shielded connector of a cable-side of a USB 2.0 (differential connector for high-speed transmission).

Figure 1:
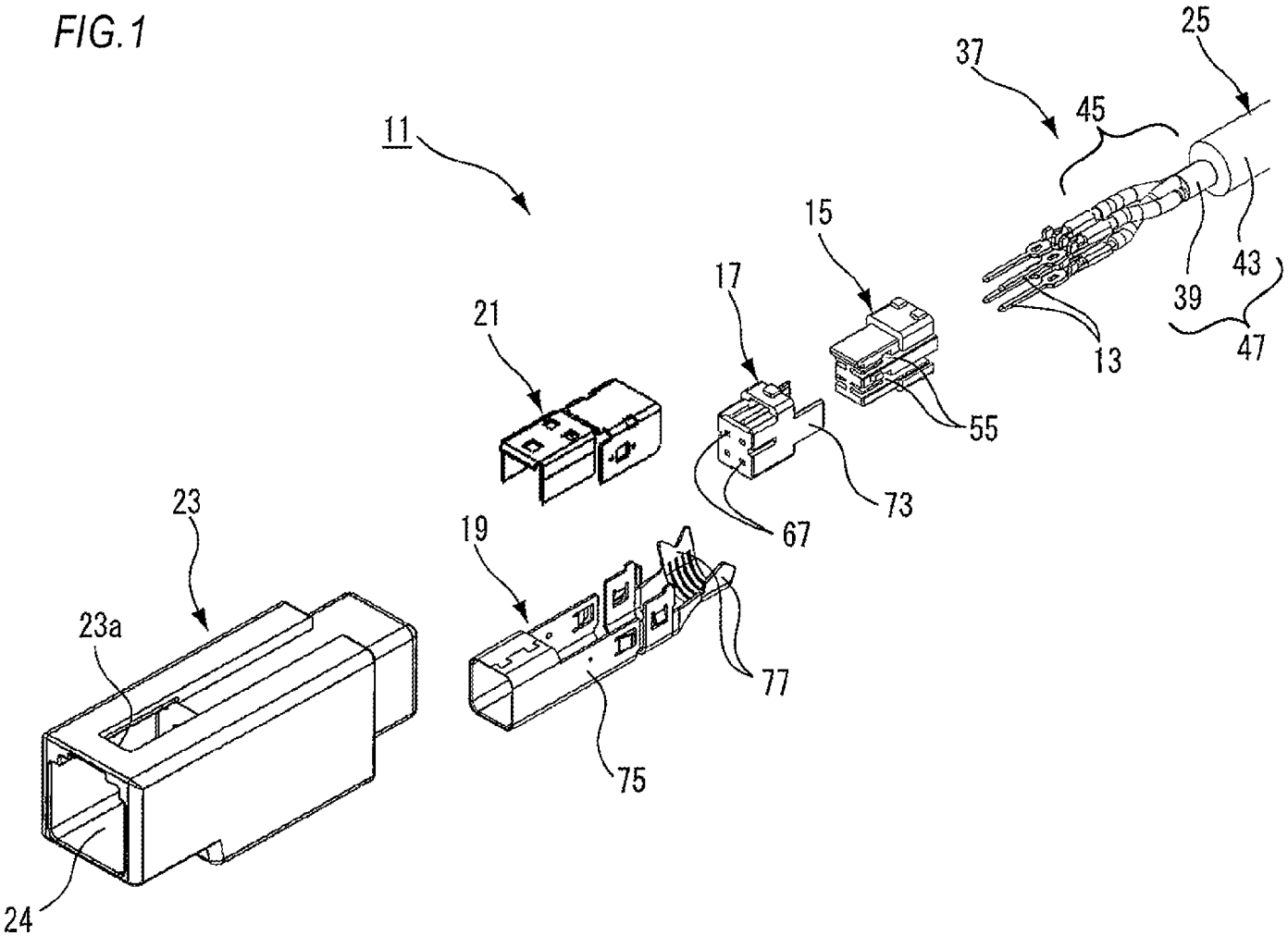
FIG. 1 is an exploded perspective view of a shielded connector according to an illustrative embodiment of the presently disclosed subject matter.

As shown in FIG. 1, the shielded connector 11 includes male terminals 13, an inner housing 15, a front holder 17, a shield shell 19, a shield shell cover 21, and an outer housing 23. Also, in the specification, the front side of the outer housing 23 (a left-lower side of FIG. 1) is referred to as the front side and the rear side of a shielded electric wire 25 (a right-upper side of FIG. 1) is referred to as the rear side.

Figure 2:
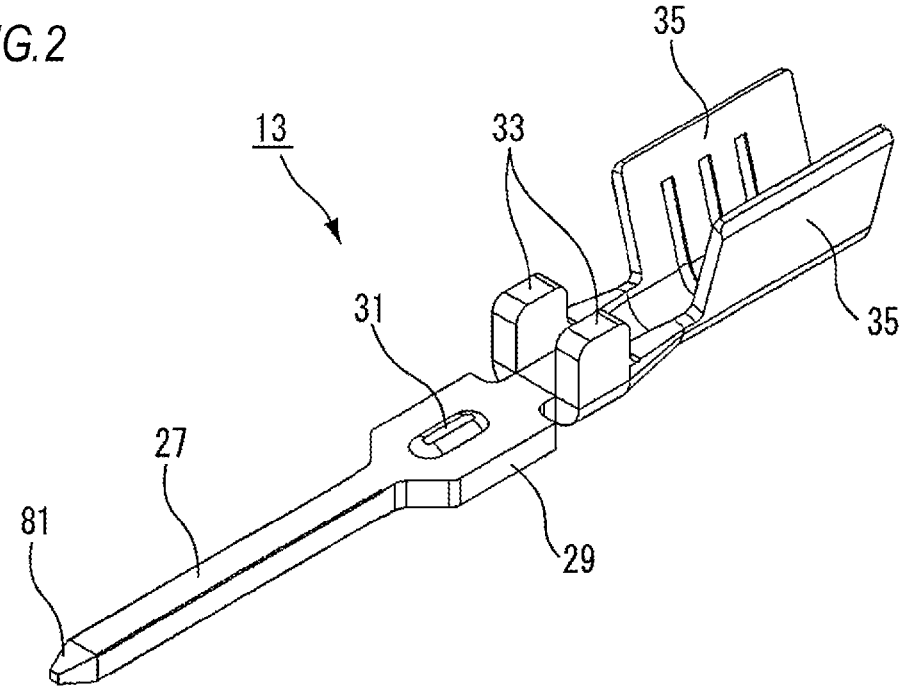
FIG. 2 is an enlarged view of a terminal shown in FIG. 1.

The male terminal 13 is made by sheet metal working and includes a tap-shaped electric contact part 27, as shown in FIG. 2. A contact base end portion 29 of the electric contact part 27 is formed with an indent 31 that is an engaging protrusion and that is formed to protrude by an extrusion molding and the like. At the rear side of the contact base end portion 29, a pair of front-rear moving control pieces 33 is provided to stand up. At the rear side of the front-rear moving control pieces 33, a pair of conductor crimping pieces 35 for crimping an inner conductor of the shielded electric wire 25 is provided to stand up. The male terminal 13 is connected to the shielded electric wire 25 to thereby form a terminal-mounted shielded electric wire 37.

The shielded electric wire 25 includes a plurality of (four, in this illustrative embodiment) inner conductors that are covered by inner protective coverings. In the specification, the inner conductor and the inner protective covering that covers the inner conductor are referred to as a shielded wire 41. The plurality of shielded wires 41 is further covered by a shield foil 39, which is an outer protective covering, and a sheath part 43, thereby forming the shielded electric wire 25. In the shielded electric wire 25, a sheath 47 comprised of at least the sheath part 43 and the shield foil 39 is required to be stripped at a connection part 45 to be connected to the male terminal 13. The part whose sheath 47 is stripped causes an impedance mismatch to thus deteriorate transmission performance. Hence, a length of the sheath 47 of the connection part 45 which is stripped is preferable as short as possible.

Figure 4:
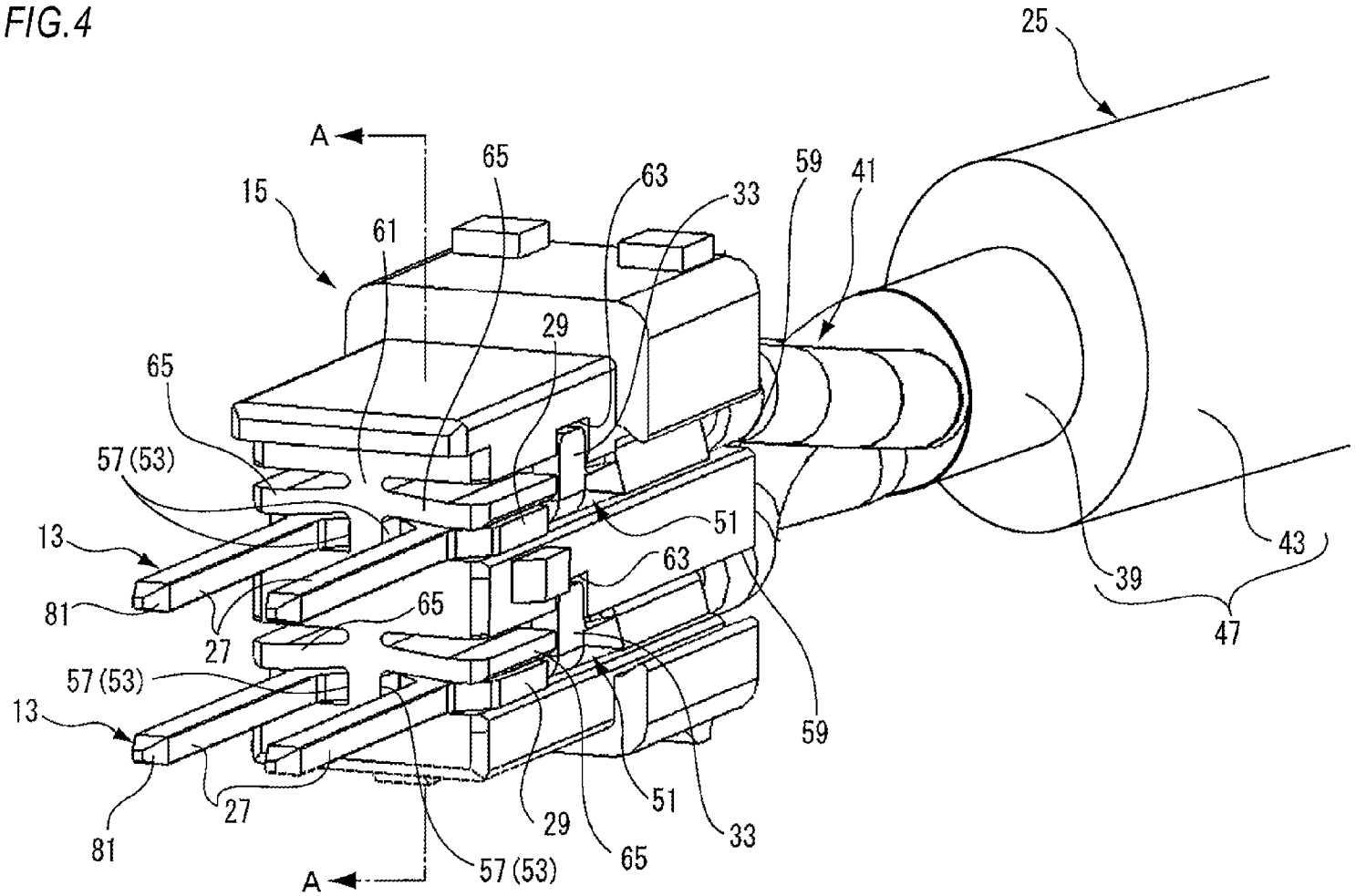
FIG. 4 is a perspective view of an inner housing having terminals mounted thereto.
Figure 5:
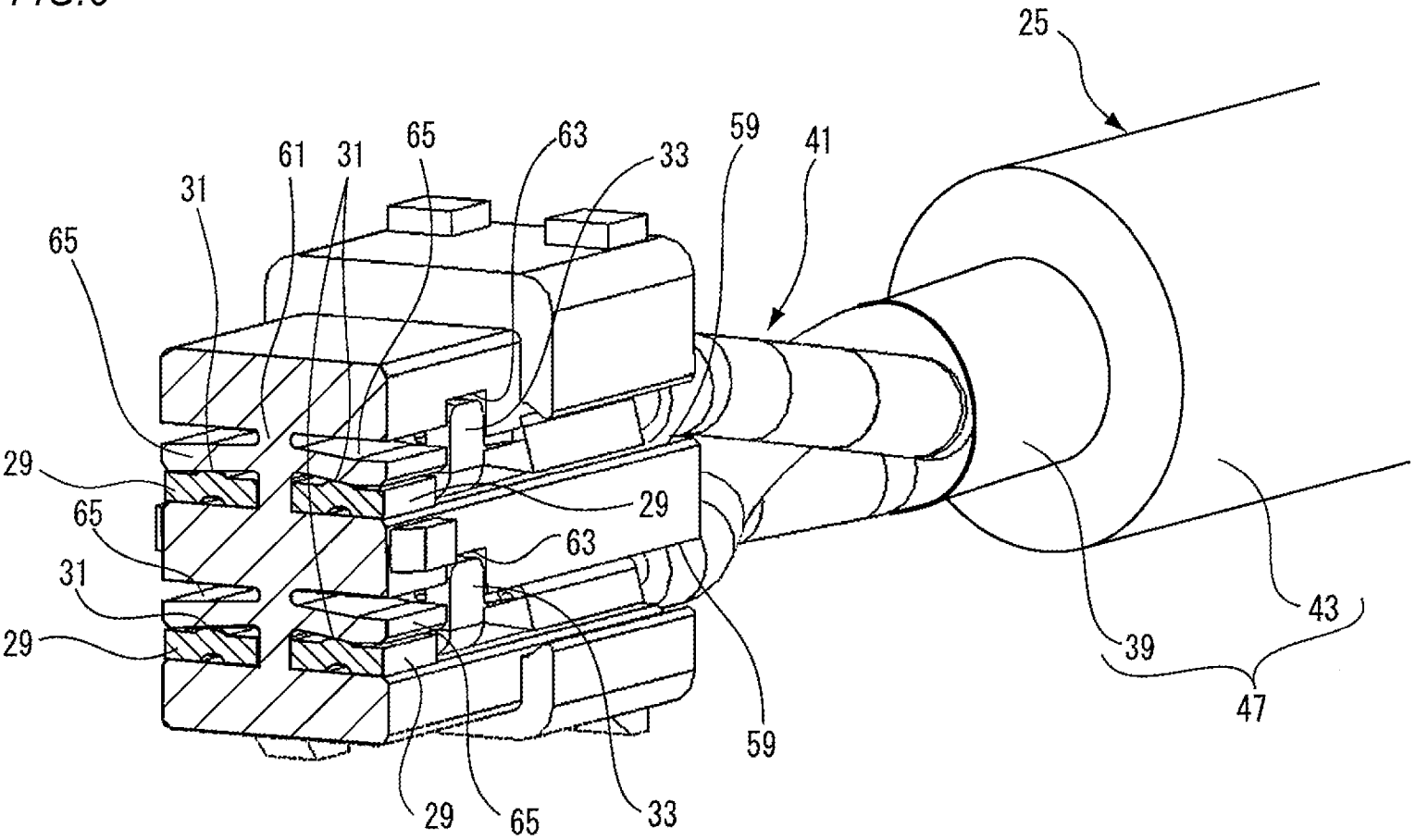
FIG. 5 is a perspective view of the inner housing shown in FIG. 4, which is cut along an A-A direction.

The inner housing 15 is formed of a synthetic resin material and includes a plurality of terminal accommodation chambers 51 (refer to FIG. 4) into which the male terminals 13 crimped to a plurality of shielded-wire ends 49 of the shielded electric wire 25 are inserted. The terminal accommodation chamber 51 has a space 53 that is opened in one side, front and rear directions. The space 53 is opened in the one side direction at one side thereof to form a terminal insertion opening 55 (refer to FIG. 9). Also, the space 53 is opened in the front direction at the front side thereof to form an electric contact part insertion hole 57 on a front surface of the inner housing 15. The space 53 is opened in the rear direction at the rear side thereof to form a shielded wire extraction opening 59 on a rear surface of the inner housing 15.

A partition wall 61 partitioning the space 53 of the terminal accommodation chamber 51 includes a recess-shaped engaging part 63 that restrains the male terminal 13, which is inserted into the space 53 from the one side, from moving in the front-rear direction, and a temporary engaging part that prevents the male terminal 13, which is inserted from the one side, from separating from the terminal insertion opening 55. In the illustrative embodiment, the temporary engaging part is configured by a flexible arm 65 that is engaged with the indent 31 protruding from the male terminal 13. A surface of the flexible arm 65, which faces the terminal, is formed with a minute convex portion (bent portion), which makes it more difficult for the indent 31 to separate, at an outer side than the indent 31. Instead of the minute convex portion, a minute recess portion that is fitted with the indent 31 may be formed.

The front holder 17 shown in FIG. 1 includes a front face plate and is inserted into a front side part of the inner housing 15. The front face plate is formed with a plurality of (four, in this illustrative embodiment) terminal through-holes 67 that coincides with the electric contact part insertion holes 57 of the inner housing 15. The front face plate is formed with a pair of holder side plates 73 extending rearward. The front holder 17 is mounted, so that the terminal insertion openings 55 of the one side of the inner housing 15 are closed by the holder side plates 73.

The shield shell 19 shown in FIG. 1 is formed by sheet metal working with a sheet metal material. The shield shell 19 includes a box-shaped shield part 75 that covers the inner housing 15 inserted therein. A barrel part 77, which crimps and fixes the sheath part 43 of the shielded electric wire 25, extends from the rear side of the shield part 75. The inner housing 15 into which the male terminals 13 of the terminal-mounted shielded electric wires 37 are inserted is inserted into the shield shell 19, so that the sheath part 43 of the terminal-mounted shielded electric wires 37 is crimped to the barrel part 77.

Figure 6A:
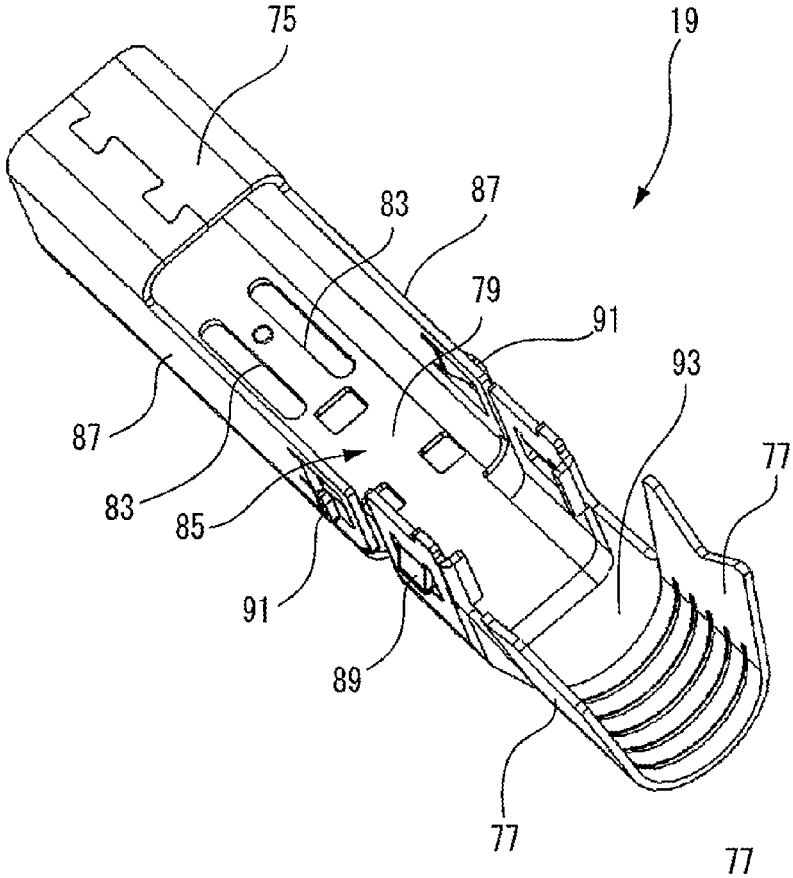
FIG. 6(*a*) is a perspective view of a shield shell, which is seen from the upper side of an insertion part, and FIG. 6(*b*) is a perspective view of the shield shell, which is obliquely seen from the lower side.
Figure 6B:
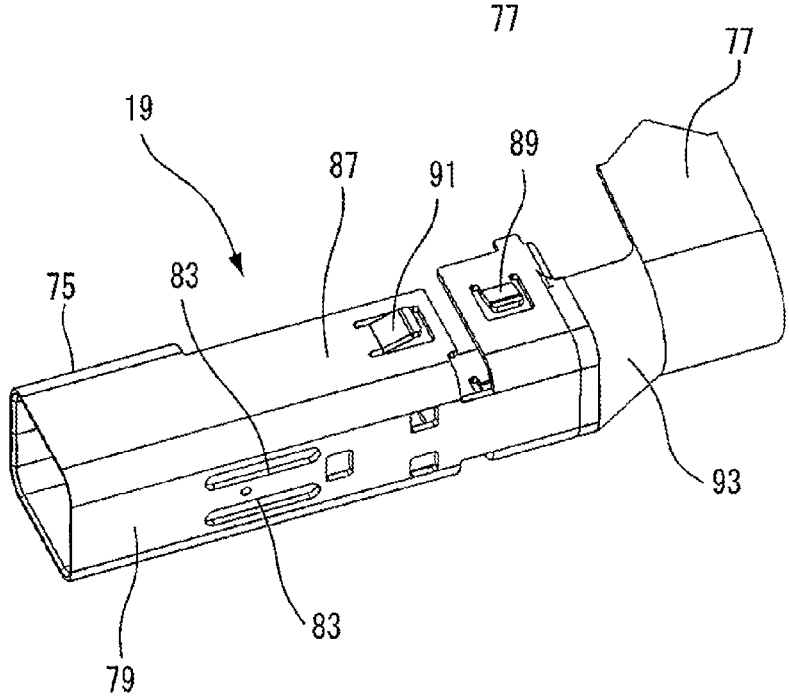

FIG. 6(*a*) is a perspective view of the shield shell 19, which is seen from the upper side of an insertion part, and FIG. 6(*b*) is a perspective view of the shield shell 19, which is obliquely seen from the lower side.

A bottom part 79 of the shield shell 19 is formed with an opening that prevents leading end portions 81 (refer to FIG. 2) of the male terminals 13 from interfering with the bottom part 79 when the inner housing 15 is inserted into the shield part 75. In the illustrative embodiment, the opening is configured by a pair of slits 83 each of which extends along a terminal insertion direction of the shield shell 19 and has a width enabling the male terminal 13 to pass therethrough.

In the shield shell 19, an insertion part 85 is opened between the cylindrical shield part 75 and the barrel part 77. The inner housing 15 having the male terminals 13 mounted thereto is inserted from the insertion part 85. Since the length of the sheath 47 that is stripped is shortened, the shield shell 19 is configured so that an interval between the shield part 75 and the barrel part 77 is narrow (short). Each of shell-side plate parts 87 that interpose the insertion part 85 therebetween is provided with a cover engaging claw 89 that engaged with the shield shell cover 21 and a housing engaging claw 91 that is engaged with the outer housing 23. A barrel taper part 93 is formed between the shell-side plate parts 87 and the barrel part 77. A diameter of the barrel taper part 93 is gradually reduced towards the barrel part 77, so that it is possible to coaxially arrange the shielded electric wire 25 to be crimped with the shield part 75.

Figure 7A:
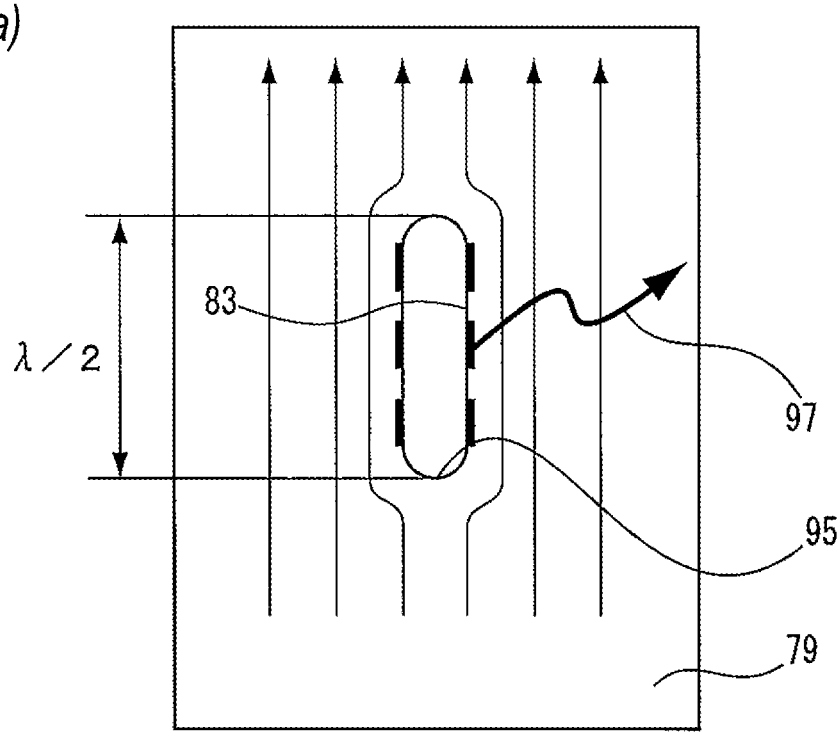
FIG. 7(*a*) is a schematic plan view of a slit according to the illustrative embodiment and FIG. 7(*b*) is a schematic plan view of a slit according to a comparative example.
Figure 7B:
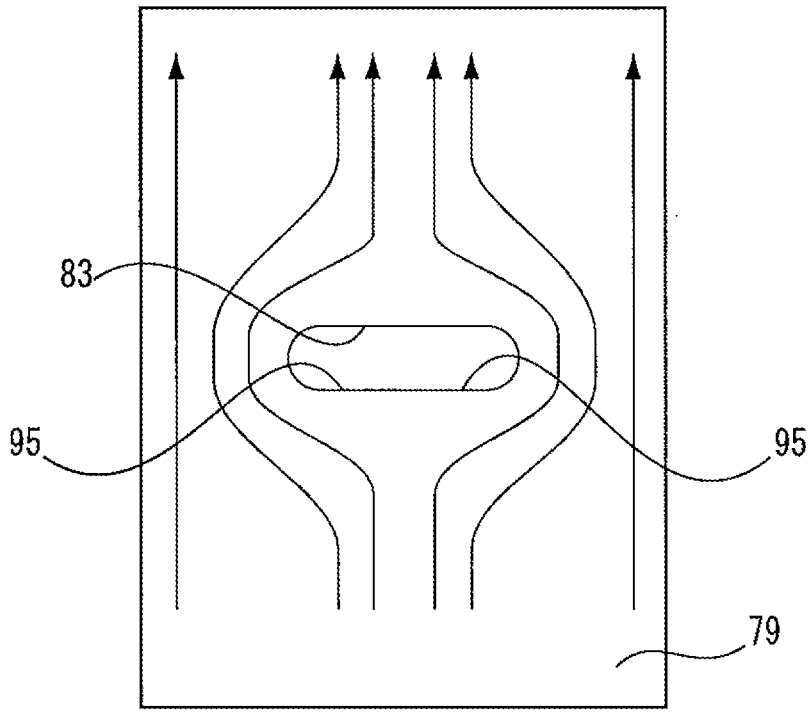

Also, when forming the opening in the shield shell 19, a shape of the opening should be noted. In the illustrative embodiment, as shown in FIG. 7(*a*), the slit 83 is elongated in a current flow direction (arrow direction in FIG. 7(*a*) and FIG. 7(*b*)) of the bottom part 79. The bottom part 79 is formed with the slit 83, so that the current is blocked at a slit upstream end portion 95 and an electric field (the vicinity of the thick broken line in FIG. 7(*a*)) is generated along the slit 83. When the electric field is generated and an electromagnetic field 97 is radiated, a shield effect is lowered, so that a noise characteristic is deteriorated. As shown in FIG. 7(*b*), the slit 83 that is formed in a direction of interfering with the current flow lowers the shield effect. In the illustrative embodiment, the slit 83 is formed along the current flow direction, as shown in FIG. 7(*a*), so that the lowering of the shield effect is suppressed. Also, when the slit 83 has a length corresponding to a half (½) of an electromagnetic wavelength (λ), an amount of the radiation becomes a maximum. In the illustrative embodiment, the slit 83 is formed to have a length avoiding a half (½) length of an electromagnetic wavelength (λ). Also with this, the lowering of the shield effect is suppressed.

The shield shell cover 21 is mounted so that it covers the insertion part 85 of the shield shell 19 from the above. Engaging holes formed on both sides of the shield shell cover 21 are engaged with engaging claws formed on both sides of the shield part 75, so that the shield shell cover 21 is fixed to the shield part 75.

The outer housing 23 is formed into an angled cylinder shape with a synthetic resin material. The outer housing 23 has a shell mounting space 24 formed therein. The inner housing 15, which is covered by the shield shell 19, is inserted and held in the shell mounting space 24. A mating connector 101 that will be described later is connector-fitted at the front side of the shell mounting space 24.

Figure 3A:
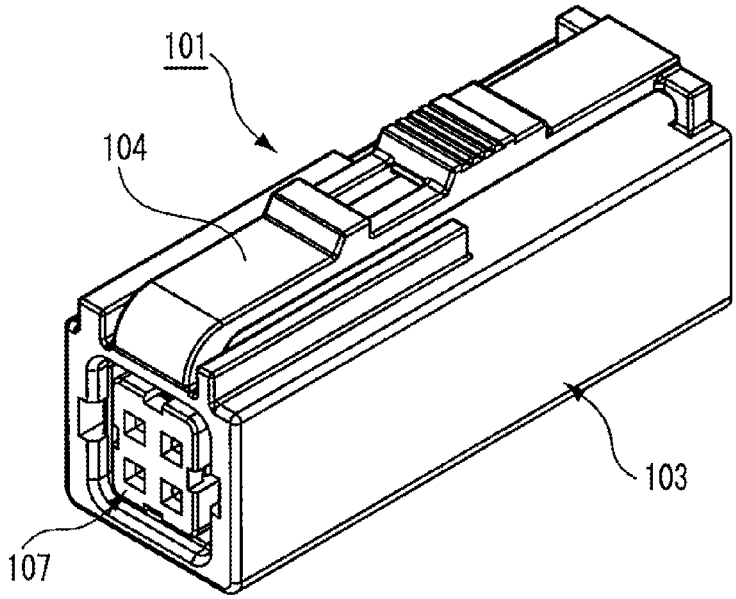
FIG. 3(*a*) is a perspective view of a mating connector and FIG. 3(*b*) is a longitudinal sectional view of the mating connector shown in FIG. 3(*a*).
Figure 3B:
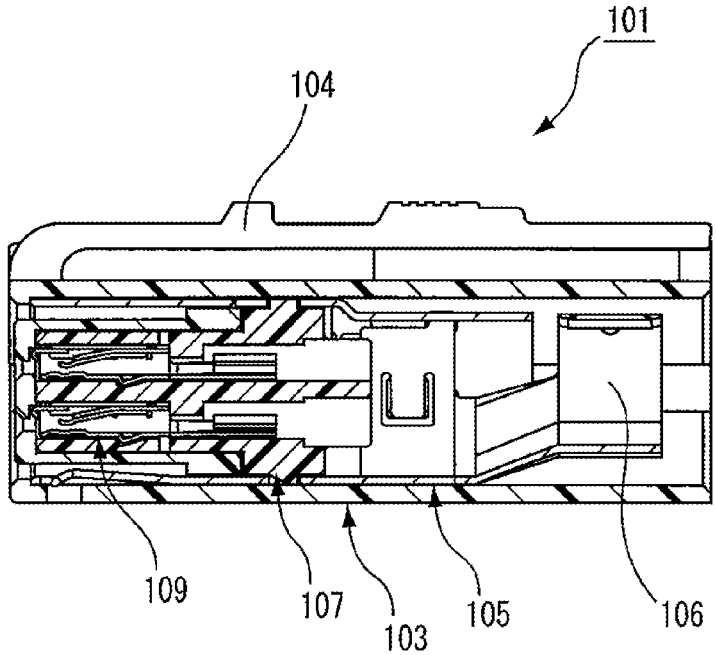

As shown in FIG. 3(*a*) and FIG. 3(*b*), the mating connector 101 includes an inner housing 107, an outer shield shell 105 that covers an outer side of the inner housing 107 and an outer housing 103.

Each of female terminals 109 that are connected to shielded wires of a shielded electric wire (not shown) includes a box-shaped electric contact part and contacts the tap-shaped electric contact part 27 of the male terminal 13 shown in FIG. 2.

When the shielded connector 11 is connector-fitted, the inner housing 107 that accommodates therein the female terminals 109 is covered by the shield part 75 of the shield shell 19.

The outer shield shell 105 is provided with a barrel part 106 to upright stand, which is crimped and fixed to the sheath part 43 of the shielded electric wire 25.

One side surface (upper surface in FIG. 3(*a*) and FIG. 3(*b*)) of the outer housing 83 that accommodates therein the outer shield shell 105 and the inner housing 107 is provided with a lock arm 104 that is locked in a lock hole 23*a* of the outer housing 23 of the shielded connector 11.

Subsequently, a sequence of assembling the shielded connector 11 is described.

Figure 8:
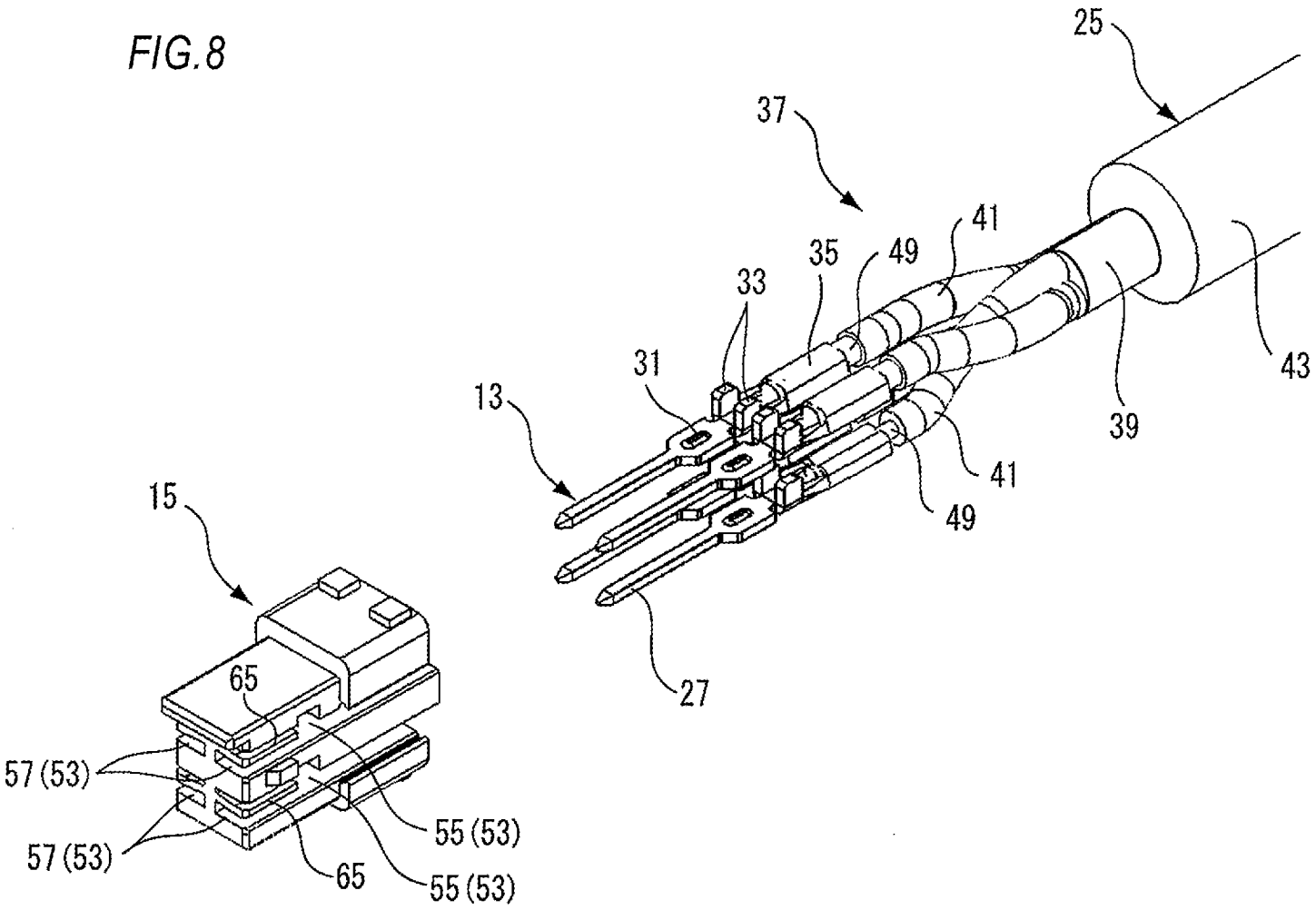
FIG. 8 is an enlarged view of the inner housing and terminal-mounted shielded electric wires shown in FIG. 1.
Figure 9:
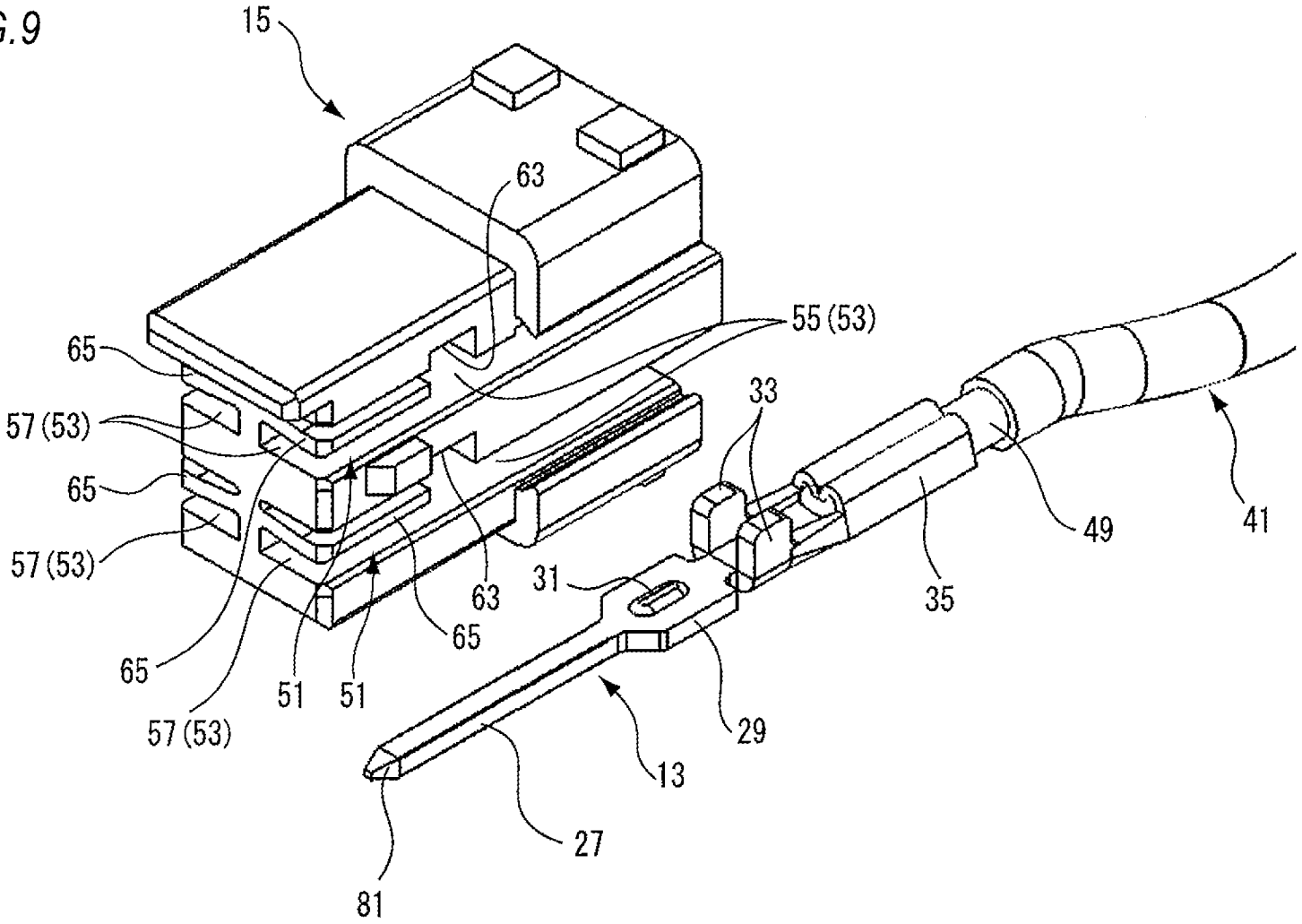
FIG. 9 is a perspective view of the inner housing just before the terminal is mounted to a terminal accommodation chamber.

As shown in FIG. 8, in order to assemble the shielded connector 11, the male terminals 13 are crimped to the plurality of shielded-wire ends 49 of the shielded electric wire 25 to thus configure the terminal-mounted shielded electric wires 37. Then, as shown in FIG. 9, each of the male terminals 13 of the terminal-mounted shielded electric wires 37 is arranged at one side of the corresponding terminal accommodation chamber 51, and is then parallel shifted to be inserted from the terminal insertion opening 55.

The shielded electric wire 25 is formed with the connection part 45 between the shielded wire 25 and the male terminals 13. In the connection part 45, the sheath 47 that binds together the plurality of shielded wires 41 is stripped, so that a restraint state by the sheath 47 is released and the male terminals 13 can be thus separated from each other. In the connection part 45, the sheath 37 is stripped within a short length range so that an impedance mismatch to deteriorate the transmission performance is not caused. When mounting the male terminals 13 to the terminal accommodation chambers 51, each of the male terminals 13 is parallel arranged at one side of the corresponding terminal accommodation chamber 51 with the connection part 45 being bent.

Figure 10:
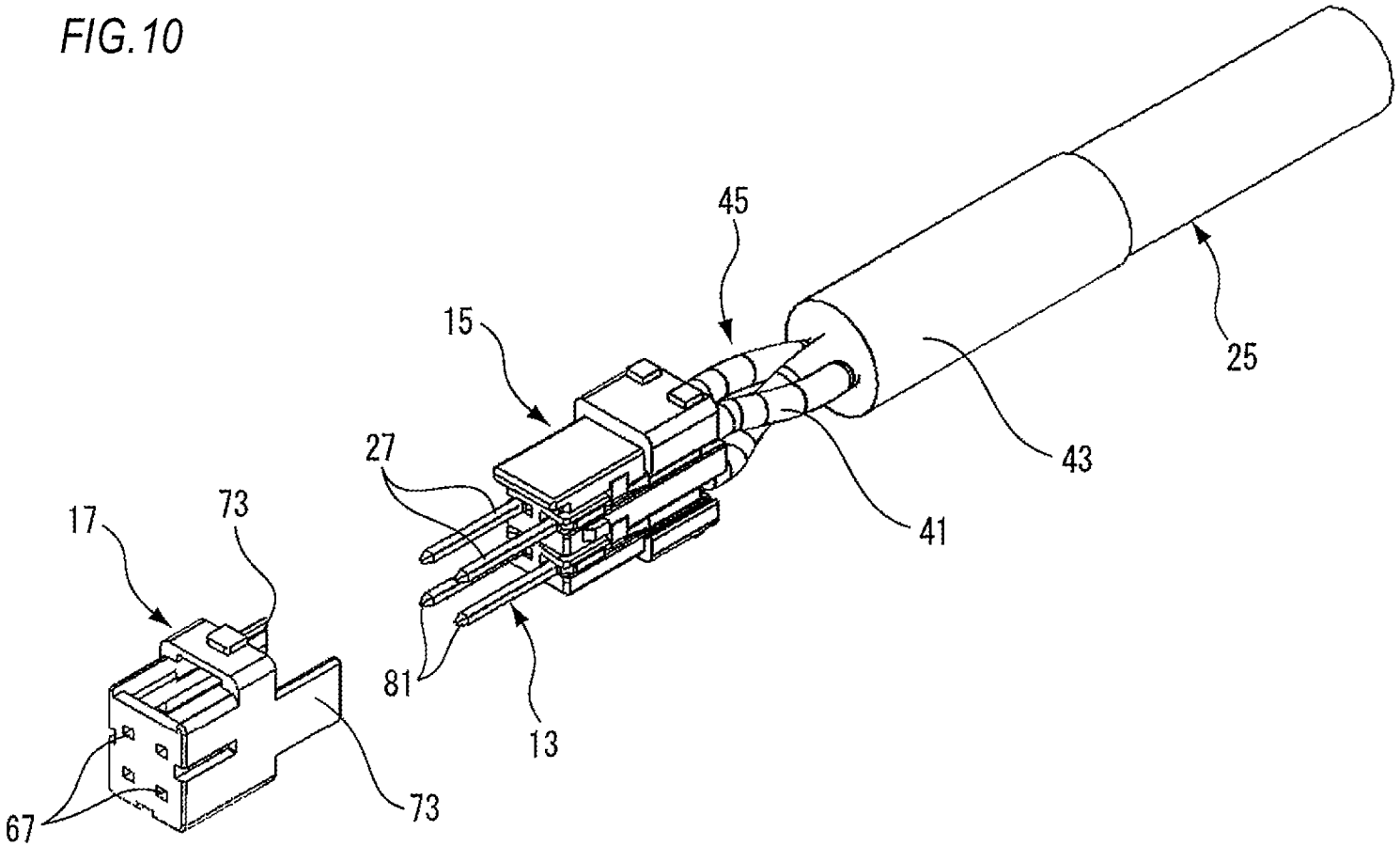
FIG. 10 is a perspective view before a front holder is mounted to the inner housing.
Figure 11:
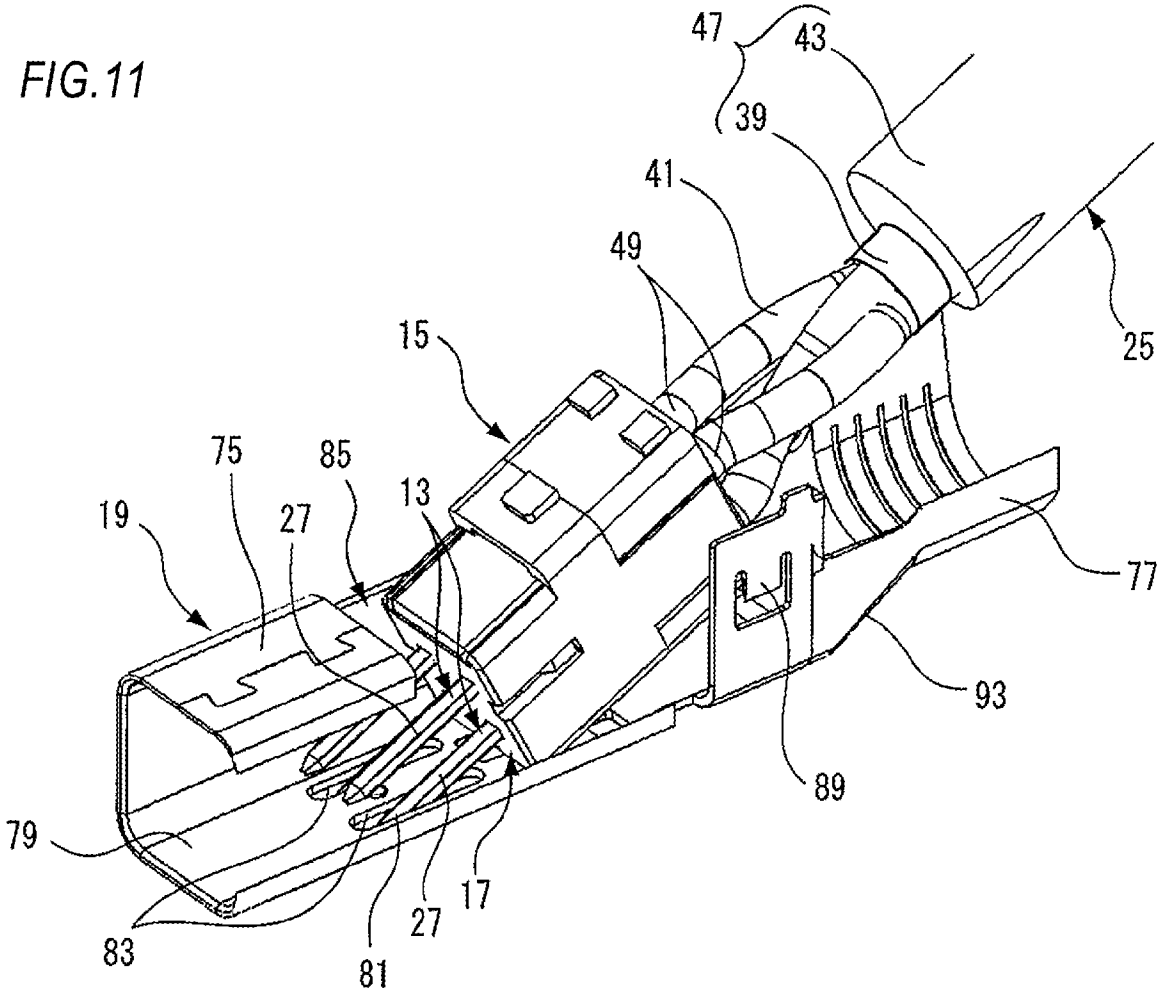
FIG. 11 is a partially cut perspective view of the shield shell showing a situation where the inner housing is obliquely inserted.
Figure 12:
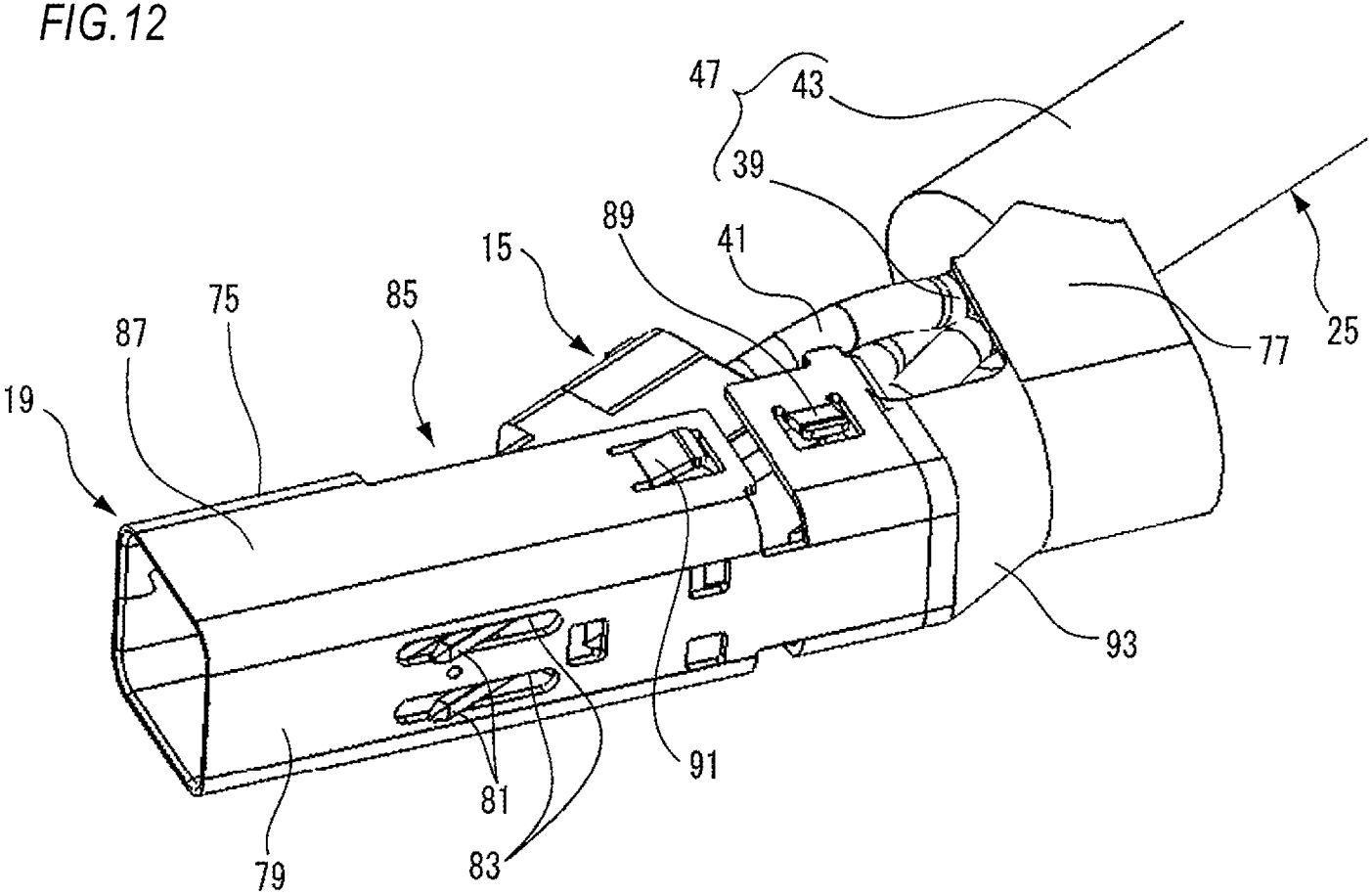
FIG. 12 is a perspective view of the shield shell shown in FIG. 11, which is obliquely seen from the lower.

Then, as shown in FIG. 10, the front holder 17 is mounted from the front side of the inner housing 15. Then, the inner housing 15 having the male terminals 13 mounted thereto is inserted in an oblique direction from the insertion part 85 of the shield shell 19, as shown in FIG. 11. When the inner housing 15 is inserted, the leading end portions 81 of the male terminals 13 are introduced into the slits 83 of the bottom part 79, so that the interference between the male terminals 13 and the bottom part 79 is prevented. As shown in FIG. 12, when the leading end portions 81 are inserted into the slits 83 by a predetermined amount, and the inner housing 15 reaches the vicinity of the bottom part 79, the inner housing 15 is direction-switched from the oblique direction to a horizontal direction.

Figure 13:
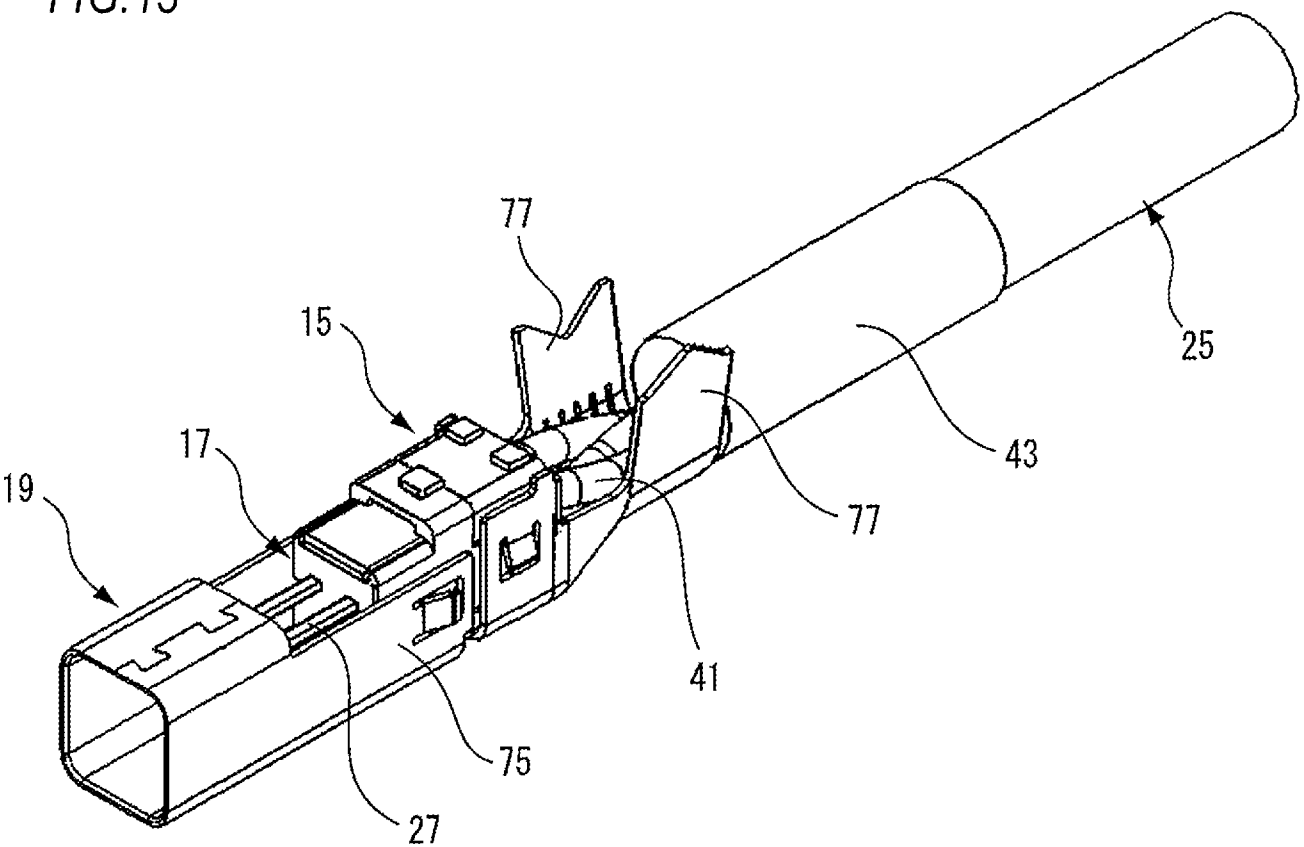
FIG. 13 is a perspective view of the shield shell while the inner housing is being incorporated.
Figure 14:
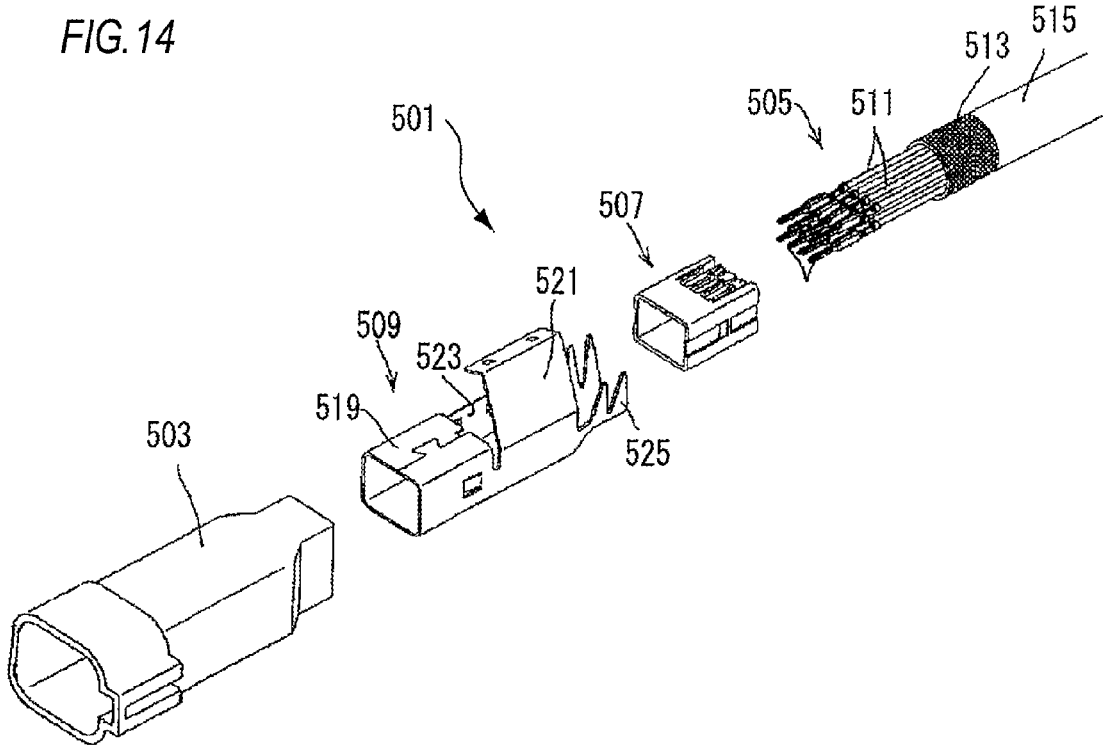
FIG. 14 is an exploded perspective view of a shielded connector of the related art.

By doing so, the inner housing 15 incorporating the front holder 17 mounted thereto is inserted and mounted to the shield part 75 of the shield shell 19 while the male terminals 13 do not interfere with the bottom part 79, as shown in FIG. 13. Subsequently, the sheath part 43 of the terminal-mounted shielded electric wires 37 to which the inner housing 15 is attached is crimped and fixed with the barrel part 77 of the shield shell 19. The shield shell cover 21 is mounted on the shield shell 19, so that the insertion part 85 of the shield shell 19 is covered. At last, the shield shell 19 is inserted into the outer housing 23.

In the below, the operations of the shielded connector 11 having the above configuration are described.

In the shielded connector 11 of the illustrative embodiment, regarding the narrow insertion part 85 where the leading end portions 81 of the male terminals 13 protrude and the inner housing 15 cannot be thus inserted into the shield part 75 of the shield shell 19 by the parallel shift, the inner housing 15 is inserted into the insertion part 85 in the oblique direction along which the male terminals 13 are directed downward. At this time, the leading end portions 81 of the male terminals 13 are inserted into the slits 83, so that it is possible to deeply insert the inner housing 15 without the interference of the male terminals 13 with the bottom part 79. Thereby, the rear end side of the inner housing 15 can avoid the barrel taper part 93, the barrel part 77 and the like of the shield shell 19, so that the inner housing can be inserted into the narrow insertion part 85. The inner housing 15 is direction-switched to the horizontal direction just before the inner housing 15 reaches the insertion part 85. Thereby, the leading end portions 81 of the male terminals 13 inserted into the slits 83 also return to the inside of the inner housing 15 from the slits 83. After that, the male terminals 13 are arranged in the cylindrical shield part 75 and the sheath part 43 of the shielded electric wire 25 extracting from the inner housing 15 is also simultaneously arranged in the barrel part 75 from the upper side.

Also, in the shielded connector 11 of the illustrative embodiment, the opening is configured by the slits 83 each of which has the width enabling the male terminal 13 to pass therethrough. Also, the slit 83 is formed to have a minimum length that does not interfere with a moving trajectory of the male terminal 13, which is inserted into the insertion part 85 in the downward oblique direction, when the inner housing 15 is direction-switched to the horizontal direction. Thereby, the lowering of the shield performance, which is caused due to the slits 83 formed on the bottom part 79, is suppressed to the minimum.

Thus, according to the shielded connector 11 of the illustrative embodiment, it is possible to prevent the interference of the leading end portions 81 of the male terminals 13 upon the insertion of the inner housing by the slits 83 formed on the bottom part 79 of the shield shell 19.

Also, the shielded connector of the presently disclosed subject matter is not limited to the above illustrative embodiment and can be appropriately modified and improved. The materials, shapes, sizes, the number, arrangement positions and the like of the respective constitutional elements in the illustrative embodiment are arbitrary and are not particularly limited insomuch as they can achieve the presently disclosed subject matter.

According to an aspect of the presently disclosed subject matter, regarding a narrow insertion part where the leading end portions of the male terminals protrude and the inner housing cannot be thus inserted into the shield part of the shield shell by parallel shift, the inner housing is inserted into the insertion part in an oblique direction along which the male terminals are directed downward. At this time, the leading end portion of the male terminal is inserted into the opening, so that it is possible to deeply insert the inner housing without interference of the male terminals with the bottom part. Thereby, a rear end side of the inner housing can avoid a barrel part and the like of the shield shell, so that the inner housing can be inserted into the narrow insertion part. The inner housing is direction-switched to a horizontal direction just before the inner housing reaches the insertion part. Thereby, the leading end portion of the male terminal inserted into the opening also returns to the inside of the inner housing from the opening. After that, the male terminals are arranged in the cylindrical shield part and the sheath part of the shielded electric wire extracting from the inner housing is also simultaneously arranged in the barrel part from the upper side.

According to an aspect of the presently disclosed subject matter, the opening is configured by the slit that has the width enabling the male terminal to pass therethrough. Also, the slit is formed to have a minimum length that does not interfere with a moving trajectory of the male terminal inserted into the insertion part in the downward oblique direction, when the inner housing 15 is direction-switched to the horizontal direction. Thereby, lowering of the shield performance, which is caused due to the opening formed on the bottom part, is suppressed to the minimum.

According to an aspect of the presently disclosed subject matter, it is possible to prevent the interference of the leading end portions of the male terminals with the shield shell upon the insertion of the inner housing by the opening formed on the bottom part of the shield shell.

What is claimed is:

1. A shielded connector comprising:

an inner housing including a plurality of terminal accommodation chambers into which male terminals crimped to a plurality of shielded-wire ends of a shielded electric wire are inserted; and a shield shell including a cylindrical shield part which covers the inner housing and a barrel part which crimps and fixes a sheath part of the shielded electric wire, wherein a bottom part of the shield shell is formed with an opening that prevents leading end portions of the male terminals from interfering with the bottom part when the inner housing is inserted into the shield part.

2. The shielded connector according to claim 1, wherein the opening is configured by a slit that extends along a terminal insertion direction of the shield shell and that has a width enabling the male terminals to pass therethrough.

* * * * *